United States Patent [19]

Hefner, Jr.

[11] 4,305,815

[45] Dec. 15, 1981

[54] CONDITIONER FOR FLOTATION OF OXIDIZED COAL

[75] Inventor: Robert E. Hefner, Jr., Lake Jackson, Tex.

[73] Assignee: The Dow Chemical Company, Midland, Mich.

[21] Appl. No.: 107,814

[22] Filed: Dec. 28, 1979

[51] Int. Cl.[3] ..... B03D 1/02

[52] U.S. Cl. ..... 209/166

[58] Field of Search ..... 209/166, 167; 252/61

[56] References Cited

U.S. PATENT DOCUMENTS

| | | | |
|---|---|---|---|
| 2,103,872 | 12/1937 | Schoellier | 209/166 X |
| 2,173,909 | 9/1939 | Kritchevsky | 209/166 |
| 2,319,394 | 5/1943 | Erickson | 209/166 X |
| 2,389,763 | 11/1945 | Cahn | 209/166 |
| 2,569,417 | 9/1941 | Jayne | 209/166 |
| 4,162,966 | 7/1979 | Finch | 209/166 |
| 4,222,862 | 9/1980 | Finch | 209/166 |

*Primary Examiner*—Robert Halper

*Attorney, Agent, or Firm*—M. L. Glenn

[57] ABSTRACT

Condensation products of a fatty acid or fatty acid ester and a hydroxyalkylated polyalkylenepolyamine are useful as conditioners to improve the recovery of clean coal in a froth flotation process. The presence of these condensation products in the flotation medium is particularly effective to enhance the recovery of oxidized bituminous coal.

8 Claims, No Drawings

CONDITIONER FOR FLOTATION OF OXIDIZED COAL

BACKGROUND OF THE INVENTION

This invention relates to the froth flotation of coal-containing ashes, coal sludge or coal-containing residues to recover coal containing a lower percentage of impurities. In particular, this invention relates to the use of a condensation product of a fatty acid or fatty acid ester and a N-hydroxyalkylated polyalkylenepolyamine compound as a conditioner for the flotation of finely-divided coal in the presence of a fuel oil collector.

The natural process of "coalification" inherently deposits some non-combustible mineral matter in association with the combustible carbonaceous solids. Large fragments of non-combustible material can be removed by screening or other gravity concentration techniques, but other cleaning methods more efficiently remove fine material intimately associated with the carbonaceous solids. Froth flotatation of coal is used in the art to beneficiate finely-divided raw coal. Bituminous coals generally possess a natural hydrophobicity, which results in the coal being floatable in the presence of a frother, such as methyl isobutyl carbinol, desirably with a relatively mild collector, such as kerosene. However, anthracite coals, as well as coals of all ranks in which the surface has been at least partially oxidized, float poorly in such a medium, resulting in the loss of significant amounts of combustible material with the tail fraction from the flotation.

The loading of the oil-type collector is generally 0.5 to 2 pounds per ton of coal feed for bituminous coals of intermediate or low rank, with the loading being relatively greater for the flotation of lignite and anthracite coals. However, good recovery of oxidized coals or lignite coals can only be effected at such high loadings of the oil-type collector that significant amounts of inert material are floated along with the combustible materials. Sun suggests in *Trans. AIME,* 199:396–401 (1954), that fatty amines can be utilized as co-collectors in the flotation of oxidized coals to effect enhanced recovery. However, even these amine collectors float substantial amounts of ash along with the coal and effect only partial recovery of combustible material.

SUMMARY OF THE INVENTION

According to this invention, coal is beneficiated in a froth flotation process comprising floating coal particles of flotation size in a frothing aqueous medium in the presence of a fuel oil collector and an effective amount of a condensation product of a fatty acid or fatty acid ester and a compound represented by formula I

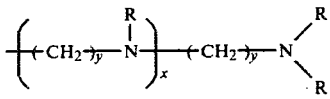

I wherein x is a whole number from 1 to 4; each y is independently 2 or 3; R at each occurrence is independently hydrogen or

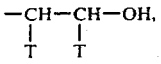

with the proviso that at least one R is not hydrogen, and wherein each T is independently hydrogen, methyl or ethyl. The aforementioned condensation product is prepared in a molar ratio of at least about one mole of fatty acid or ester for each mole of the compound of formula I.

DETAILED DESCRIPTION OF THE INVENTION

The compounds of formula I are hydroxyalkylated diethylenetriamine, triethylenetetramine, tetraethylenepentamine, pentaethylenehexamine, analogous compounds in which at least one propylene moiety is present instead of an ethylene group, or mixtures thereof. Mixtures of the aforementioned hydroxyalkylated polyalkylenepolyamines are preferred. Hydroxyalkylated polyethylenepolyamines and mixtures thereof are especially preferred. Hydroxyalkylated diethylenetriamine, triethylenetetramine and mixtures thereof are the most preferred polyalkylenepolyamine reactants for the condensate.

The compounds of formula I are readily prepared by reacting the corresponding polyalkylenepolyamine with an alkylene oxide in a manner known to the art. Representative alkylene oxides include ethylene oxide, 1,2-propylene oxide, 1,2-butylene oxide, 2,3-butylene oxide, isobutylene oxide and 2,3-pentylene oxide. The hydroxyalkylation reaction is conveniently effected by contacting in the stoichiometric ratio the polyalkylenepolyamine and the alkylene oxide in the liquid phase at a temperature of from about 50° C. to about 150° C. Multiple hydroxyalkyl groups can be added to the polyethylenepolyamine by employing more than one equivalent of alkylene oxide for each equivalent of the polyalkylenepolyamine. The preferred alkylene oxide reactants are ethylene oxide and propylene oxide. Mixtures of the aforementioned alkylene oxides are also operable.

The fatty acid condensed with the compounds of formula I can operably be an acid represented by the formula

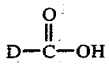

wherein D is an aliphatic radical having 4 to 22 carbon atoms. Oleic, lauric, linoleic, palmitic, stearic, myristic acids, mixtures thereof and other like fatty acids are operable. The esters corresponding to these fatty acids, such as glycerides, are also operable, but less preferred. For reasons of economy, it is preferred to use crude mixtures of fatty acids, rosin acids, lignin and unsaponifiable material, such as tall oil, coconut oil, palm oil, palm kernel oil, cottonseed oil, olive oil, linseed oil, peanut oil, fish oil and the like. Tall oil or tall oil heads are an especially preferred mixtures of fatty acids and rosin acids. Preferably, the tall oil reactant contains less than about 40 percent rosin acids by weight. Tall oil and tall oil heads are well-known compositions described in the *Kirk-Othmer Encyclopedia of Chemical Technology,* 2nd Ed., Vol. 19, pp. 614–629 (1969), which is incorporated herein by reference.

The compound of formula I is condensed with a fatty acid or its ester by bringing these reactants together and heating until the desired degree of condensation has taken place, as indicated by the water distilled overhead or infrared spectrophotometric analysis of the condensation product. Generally, a reaction temperature of from about 120° C. to about 250° C. is operable. This reaction is termed a condensation to distinguish it from the formation of the ammonium salt of the carboxylic acid, which occurs at lower reaction temperatures. Dependent on the reactant, the condensation product may be an ester, an amide or both. Although it is desirable that the condensation reaction is substantially complete to make most efficient use of the reactants, the condensation product is operable, but less effective, as a conditioner for coal in the presence of a substantial amount of unreacted fatty acid and the uncondensed ammonium salt of the acid. The term "conditioner" indicates that the condensation product is primarily effective to enhance the hydrophobicity of the coal surface. The use of the descriptive term "conditioner" is not intended to exclude the possibility that this condensation product acts as a co-collector with the fuel oil or kerosene collector. The term "condensation product", as used herein, refers to not only the condensation product in its free form, but also acid derivatives thereof, as described hereafter.

The above-describd condensation products neutralized or partially neutralized with inorganic or organic acids are operable as conditioners in the instant flotation process, but are generally less efficacious than the condensates in their free form. These derivatives are frequently more readily dispersed in the aqueous flotation medium than are the parent compounds. These acid derivatives may be either a salt, partial salt or acid complex, depending on the acid and condensate employed. Common inorganic acids which can be used to prepare these derivatives include phosphoric, nitric, boric, hydrochloric, hydrobromic, sulfuric and alkane sulfonic acids. Organic carboxylic acids which can be used include aliphatic mono-, di-, or tricarboxylic acids; lower alkyl carboxylic acids; mono- or dihydroxy lower alkyl carboxylic acids and amino-substituted compounds thereof; and unsaturated aliphatic acids. Examples of these organic acids include formic, acetic, hydroxyacetic, propionic, butyric, isovaleric, lactic, gluconic, aminoacetic, malonic, succinic, adipic, malic, tartaric, glutaric, maleic, fumaric, citric, isocitric, aconitic, oxalic, salicylic, benzoic, and naphthenic acids, and the like. Fatty acids can also be employed for this purpose, but are not as desirable as other lower organic acids. The $C_1$ to $C_4$ organic acids are preferred. Acetic acid is particularly preferred to prepare so-called partial acetate salts by the partial neutralization of the condensation product with acetic acid.

The efficacy of the instant organic carboxylic acid condensation product is greatest when the reactants are condensed in a specific range of mole ratios. Advantageously at least about one equivalent of fatty acid or ester is condensed with each equivalent of a hydroxy or secondary amine moiety. To avoid waste of fatty acid or ester, the number of moles of fatty acid and/or ester reacted with the compound of formula I should not exceed the number of moles of the compound of formula I multiplied by the average number of reactive sites on a molecule of the compound. The term "reactive sites" refers to the exchangeable hydrogen substituents on the amine group(s) and the reactive hydroxyl substituents on the hydroxyalkyl group(s), which will react with the fatty acid or fatty acid ester to produce amides and esters respectively. In the foregoing mole ratios, the moles of fatty acid in crude mixtures derived from natural sources do not include the moles of such minor generally inert compounds as unsaponifiable matter.

The loading of the condensation product in the flotation medium which affects the greatest recovery of combustible carbonaceous matter with a tolerable amount of inert matter is dependent upon such factors as the size, rank, degree of oxidation and inert matter content of the coal feed, as well as the loading of frother and other adjuvants. The term effective amount is used herein to denote the amount of said compounds required to increase the recovery of coal by froth flotation in the presence of fuel oil and a frother. Generally, when this conditioner is employed with only fuel oil and a frother, the condensate is advantageously employed in a ratio of from about 0.01 to about 1.0, preferably about 0.005 to about 0.5 kilograms, of condensate per metric ton of coal flotation feed.

The instant conditioner can be utilized in conjunction with co-collectors or other adjuvants, such as activators, conditioning reagents, dispersing reagents, frothing reagents and depressing reagents. Fuel oil is employed in the flotation medium as a collector and/or dispersing reagent. Representative fuel oils include diesel oil, kerosene, Bunker C fuel oil, mixtures thereof and the like. The fuel oil can generally be advantageously employed in a ratio of from about 0.25 to about 2.5 kilograms fuel oil per metric ton of coal flotation feed. The optimal loading of fuel oil in the flotation medium is influenced by numerous factors, such as the size, degree of oxidation and rank of the coal to be floated and the loading of conditioner and frother. Therefore, the loading of the fuel oil should be optimized empirically to effect the greatest selectivity and recovery during flotation. It is generally desirable to introduce the condensation product to the flotation medium in a fuel oil emulsion.

A frothing agent should be present in the flotation medium to promote formation of a froth. Conventional frothers, such as pine oil, cresol, isomers or amyl alcohol and other branched $C_4$ to $C_8$ alkanols are suitable for this purpose. However, methyl isobutyl carbinol and polypropylene glycol alkyl or phenyl ethers are preferred as frothers, with polypropylene glycol methyl ethers having a weight average molecular weight of from 200 to 600 being more preferred. The optimal loading of frother in the flotation medium is influenced by a number of factors, most important of which is the particle size, rank and degree of oxidation of the coal. Generally, a ratio of from 0.05 to about 0.5 kilogram of frother per metric ton of coal feed is advantageous.

The coal to be floated by the instant process can suitably be anthracite, bituminous, subbituminous and the like. This process is preferably employed to float coal which cannot be floated with conventional frothers alone and is particularly effective in the flotation of bituminous coal of intermediate or low rank, where the surface of the coal is oxidized to an extent which significantly impedes the flotation of the coal by conventional methods.

The size of the coal flotation feed is important as generally particles larger than about 28 mesh (U.S. Sieve Size) are difficult to float. In typical operations, coal particles larger than 28 mesh, advantageously larger than 100 mesh, are separated from both the inert material mined therewith and more finely divided coal by gravimetric separation techniques. However, if a substantial fraction of the coal in the flotation feed is contained in particles larger than 28 mesh, it is desirable that the feed is comminuted prior to flotation.

The sized coal flotation feed in preparation for flotation is first optionally washed and then mixed with sufficient water to prepare an aqueous slurry having a concentration of solids which promotes rapid flotation. Generally, a solids concentration of from about 2 to about 20 weight percent solids, more preferably about 5 to about 15 weight percent, is preferred. The aqueous coal slurry is desirably conditioned with the condensation product, a frother, fuel oil and any other adjuvants by mixing or agitating the slurry prior to flotation in a manner known to the art. Generally for difficult to float coal, it is advantageous to contact with mixing the coal slurry with the conditioner and fuel oil for a period of time prior to flotation, so as to effect intimate contact of the conditioner and fuel oil with substantially all of the coal. Where the aqueous coal slurry is prepared in a container distinct from the flotation cell and then is conveyed to the flotation through conduits, the desired intimate contact can conveniently be attained by introducing the conditioner and fuel oil to the slurry upstream from the flotation cell. The frother, however, should be introduced to the slurry shortly before or during flotation to provide maximum frothing.

The coal is operably floated at the natural pH of the coal in the aqueous slurry, which can vary from about 3.0 to about 9.5 depending upon the composition of the feed. However, a pH adjusting composition is optionally used as necessary to adjust and maintain the pH of the aqueous coal slurry prior to and during flotation to a value from about 4 to about 9, preferably about 4 to about 8, which generally promotes the greatest coal recovery. If the coal is acidic in character, the pH adjusting composition can operably be an alkaline material, such as soda ash, lime, ammonia, potassium hydroxide or magnesium hydroxide, with sodium hydroxide being preferred. If the aqueous coal slurry is alkaline in character, a carboxylic acid, such as acetic acid and the like, or a mineral acid, such as sulfuric acid, hydrochloric acid and the like, are operable to adjust the pH.

The conditioned and pH-adjusted aqueous coal slurry is aerated in a conventional flotation machine or bank of rougher cells to float the coal. Any conventional rougher flotation unit can be employed.

The practice of the process of the instant invention can be used to beneficiate coal without the aid of secondary processes. Alternatively, the process can be used in conjunction with secondary flotations following the instant process to effect even greater beneficiation of the coal.

The following examples are illustrative embodiments of this invention. Unless otherwise indicated, all parts and percentages are by weight.

EXAMPLES 1–5

In a series of substantially identical flotation runs that differ principally in the identity of the frother and presence or absence of a conditioner, 200 grams of comminuted coal is diluted with deionized water to a slurry of 6.67 percent solids. The coal is a low grade, bituminous coal having a highly oxidized surface as indicated by the high oxygen content (14.3 percent) of the coal. The fraction of the coal feed consisting of particles larger than 25 mesh is separated, comminuted and then recombined with the remainder of the coal prior to dilution. The comminuted coal feed is more than 90 percent particles smaller than 80 mesh. The coal as charged to the slurry contains 14.7 percent ash.

The conditioner is prepared in a two-step process. In the first step, 1 equivalent of diethylenetriamine (DETA) is reacted with 1, 3 or 5 equivalents of ethylene oxide (EO) at a temperature of from 100° to 135° C. for from 2 to 8 hours. The resulting hydroxyethylated product is then condensed with 2, 3 or 4 equivalents of a tall oil fatty acid (TOFA) at a temperature from about 130° C. to about 225° C. until the reaction is substantially complete. Infrared spectrophotometric analysis is employed to confirm that the reaction is substantially complete in each instance. This tall oil fatty acid according to analysis by conventional methods contains 39 percent rosin acids, 29.3 percent oleic acid, 23 percent linoleic acid, 3.7 percent conjugated linoleic acid, 1.8 percent stearic acid and about 5 percent other acids and components.

The aqueous coal slurry is introduced into a flotation machine (specifically, a Galigher Agitair Flotation Machine) having a three-liter cell. The pH of the slurry (initially 4) is adjusted to 7 by adding sodium hydroxide. The coal slurry is agitated for about seven minutes to thoroughly wet the coal, at which time 0.5 gram of a refined kerosene (sold under the name SOLTROL ® 100 by Phillips Petroleum Co.) is added to the slurry to effect a loading of 2.5 kilograms of kerosene per metric ton of coal feed. One-half milliliter of a 5 percent solution of one of the aforementioned conditioners in kerosene is added in each of five flotation runs. A single control flotation run is also made, in which no conditioner is added with the kerosene.

Next 0.04 ml of a polypropylene glycol methyl ether frothing agent having an average molecular weight of about 400 is added to the medium as a frothing agent. The aqueous coal slurry is conditioned by agitation for one minute, after which aeration of the medium is initiated and continued for four minutes. A frothy concentrate is collected during aeration.

The collected concentrate is first dried in an oven and then weighed. The percent recovery of coal by flotation is determined from the weight of coal in the concentrate divided by the weight of coal (i.e., total weight less weight of ash) in the 200-gram charge. A one-gram sample of the concentrate is completely burned and the ash content of the concentrate is determined from the weight of the material remaining after combustion. Table I tabulates the identity of the conditioner for each run as well as the percent recovery of coal and ash content in the concentrate.

TABLE I

| Example | Conditioner Composition (Ratio-DETA:EO:TOFA) | Coal Recovery (%) | Ash Content (%) |
|---|---|---|---|
| 1 | 1:1:4 | 66.2 | 10.2 |
| 2 | 1:3:2 | 50.9 | 9.9 |
| 3 | 1:3:3 | 60.2 | 10.1 |
| 4 | 1:3:4 | 65.5 | 10.0 |
| 5 | 1:5:4 | 58.5 | 9.6 |
| Comparative Experiment* | none | 35.9 | 9.1 |

*Not an embodiment of this invention.

EXAMPLE 6

In a manner otherwise similar to Example 1, a condensate of monohydroxypropylated DETA and 4 equivalents of TOFA is employed as the conditioner.

This conditioner effected coal recovery of 64.6 percent and an ash content of 10.4 percent.

EXAMPLE 7

In a manner otherwise similar to Example 1, a condensate of tetrahydroxyethylated triethylenetetramine and 5 equivalents of TOFA is employed as the conditioner. This conditioner effected coal recovery of 65.8 percent and an ash content of 10.4 percent.

EXAMPLE 8

In a manner otherwise similar to Example 4, the condensate of trihydroxyethylated DETA and 4 equivalents of TOFA as a 5 percent emulsion in kerosene is neutralized to a pH of 5 with acetic acid and then is immediately employed as the conditioner. This conditioner effected coal recovery of 41.3 percent and an ash content of 9.8 percent.

What is claimed is:

1. A froth flotation process for the beneficiation of coal which comprises floating coal particles of flotation size in a frothing aqueous medium in the presence of a fuel oil collector and an effective amount of a condensation product of a fatty acid or fatty acid ester and a compound represented by the formula I

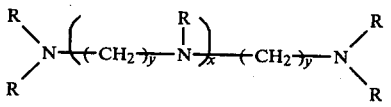

I wherein x is a whole number from 1 to 4; each y is independently 2 or 3; R at each occurrence is independently hydrogen or

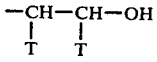

with the proviso that at least one R is not hydrogen, and wherein each T is independently hydrogen, methyl or ethyl; said condensation product being prepared in a molar ratio of at least about one mole of fatty acid or ester for each mole of the compound of formula I and said condensation product being employed in its free form or as an acid derivative with the proviso that a significant percentage of the compounds in the condensation product bear amide moieties.

2. The process as described in claim 1 wherein the coal is a bituminous coal having an oxidized surface.

3. The process as described in claim 1 wherein y at each occurrence in formula I is 2.

4. The process as described in claim 3 wherein x is 1 or 2.

5. The process as described in claim 1 or 4 wherein in each moiety of the formula

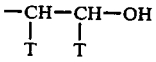

in the compound of formula I, T at one occurrence is hydrogen and T at the other occurrence is hydrogen or methyl.

6. The process as described in claim 1 wherein the condensation product is present in its free form.

7. The process as described in claim 1 wherein the condensation product is present as an acetic acid neutralized derivative.

8. The process as described in claim 1 wherein the fatty acid or ester is a tall oil fatty acid, tall oil heads, a tall oil fatty acid or a mixture thereof.

* * * * *

UNITED STATES PATENT AND TRADEMARK OFFICE

CERTIFICATE OF CORRECTION

PATENT NO. : 4,305,815

DATED : December 15, 1981

INVENTOR(S) : Robert E. Hefner, Jr.

It is certified that error appears in the above—identified patent and that said Letters Patent is hereby corrected as shown below:

Column 1, line 22, "flotatation" should read -- flotation --;

Column 1, formula I, that portion of the formula reading

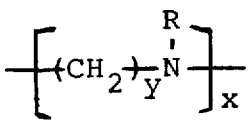

should read

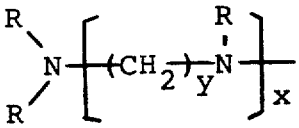

,

Column 3, line 23, "above-describd" should read -- above-described -- ;

Column 4, line 13, "when" should read -- where -- ;

Column 4, line 40, "or" should read -- of -- .

Signed and Sealed this

Thirteenth Day of July 1982

[SEAL]

Attest:

GERALD J. MOSSINGHOFF

Attesting Officer

Commissioner of Patents and Trademarks